US008766552B2

(12) United States Patent
Lee et al.

(10) Patent No.: US 8,766,552 B2
(45) Date of Patent: Jul. 1, 2014

(54) LIGHT GENERATING DEVICE AND METHOD FOR CONTROLLING THE DEVICE

(75) Inventors: Jung Won Lee, Seoul (KR); Hang Geun Jeong, Jeonju (KR)

(73) Assignee: Semisolution Inc., Yongin, Gyounggi-Do (KR)

( * ) Notice: Subject to any disclaimer, the term of this patent is extended or adjusted under 35 U.S.C. 154(b) by 392 days.

(21) Appl. No.: 13/227,533

(22) Filed: Sep. 8, 2011

(65) Prior Publication Data

US 2012/0062119 A1 Mar. 15, 2012

(30) Foreign Application Priority Data

Sep. 9, 2010 (KR) ..... 10-2010-0088286

(51) Int. Cl.
*H05B 37/02* (2006.01)

(52) U.S. Cl.
USPC ..... 315/291; 315/185 R; 315/308

(58) Field of Classification Search
USPC ..... 315/185 R, 152–158, 209 R, 291, 307, 315/308, 312
See application file for complete search history.

(56) References Cited

U.S. PATENT DOCUMENTS

2004/0160199 A1* 8/2004 Morgan et al. ..... 315/312
2012/0038286 A1* 2/2012 Hasnain ..... 315/250

* cited by examiner

*Primary Examiner* — Jimmy Vu
(74) *Attorney, Agent, or Firm* — Ked & Associates, LLP

(57) ABSTRACT

A light generating device includes: an LED module that includes a number of LED groups each of which has a number of LEDs, a memory for storing drive current for a number of LED groups respectively, an LED module driving unit for driving one of the LED groups, a current controller for controlling the drive current flowing to the LED module driving unit to drive the selected LED group, a temperature sensor for sensing heat created from the selected LED group, an operation unit for calculating the correct drive current when LEDs in the selected LED group emit light, and a key input unit for selecting one of the LED groups or a number of LED groups. The light generating device increases the light emission efficiency.

18 Claims, 7 Drawing Sheets

LIGHT GENERATING DEVICE AND METHOD FOR CONTROLLING THE DEVICE

BACKGROUND OF THE INVENTION

1. Field of the Invention

The invention relates to light emitting diodes (LEDs), and more particularly to a light generating device and a method for controlling the device.

2. Description of the Conventional Art

A Light Emitting Diode (LED) is a light source that operates with lower voltage and small amount of current. LEDs are high in the efficiency and have a long life span, compared with other light sources, such as electric lights, florescent lights, etc.

In recent years, with the development of high-brightness LEDs, illumination devices have also been researched to employ the high-brightness LEDs.

Since LED illumination devices consume less electric power than usual illumination devices employing electric lights such as, florescent lights, or the like, and can also be used for a relatively long time, their applications will increase.

For example, an LED module can be manufactured in such a manner that a number of LEDs are arrayed on a base plate (e.g., a printed circuit board (PCB)) in a matrix form. The LED module makes it to easily apply a number of LEDs to illumination devices. Since each LED module has a number of LEDs, it has a high level of brightness.

However, conventional LEDs are disadvantageous in that they have a relatively large deviation of light wavelengths because their manufacturing processes are irregular and they age in use.

Therefore, when conventional LEDs are used in applications where the characteristic of the peak wavelength is critically important, they require a system for controlling the peak wavelength.

SUMMARY OF THE INVENTION

The invention has been made in view of the above problems, and provides a light generating device that can create a peak wavelength from LEDs and accurately maintain it.

The invention further provides a method for controlling the light generating device.

The invention further provides a technology that constantly maintains the temperature of an LED module in a certain range and thus minimizes the variation in the wavelength of light output from the LED module.

The invention further provides a technology that corrects the light wavelength varied according to the temperature variation in an LED module and thus maintains a constant light wavelength from the LED module.

According to an aspect of the present invention, there is provided a light generating device comprising: an LED module, a memory, an LED module driving unit, a current controller, a temperature sensor, an operation unit, and a key input unit. The LED module includes a number of LED groups each of which has a number of LEDs, where the LED groups have different types of LEDs respectively. Each LED group has the same type of LEDs. The memory stores drive current for a number of LED groups, respectively. The LED module driving unit drives one of the LED groups that is selected, so that the selected LED group emits light. The current controller controls the drive current flowing to the LED module driving unit to drive the selected LED group. The temperature sensor senses heat created from the selected LED group. The operation unit calculates the correct drive current when LEDs in the selected LED group emit light, by referring to the drive current for driving the selected LED group and the temperature acquired by the temperature sensor. The operation unit transfers the correct drive current to the current controller. The key input unit selects one of the LED groups or a number of LED groups.

Preferably, the LED module comprises: a base plate with LEDs arrayed in the matrix form; a heat discharging layer attached to the lower side of the base plate; and a number of heat transfer pins, passing through the base plate to the heat discharging layer, for transferring heat from the LEDs to the heat discharging layer.

According to another aspect of the present invention, there is provided a method for controlling a light generating device with an LED module that includes a number of LED groups each of which has a number of LEDs, where the LED groups have different types of LEDs respectively, each group having the same type of LEDs. The method comprises: driving the LEDs in a selected LED group using drive current; sensing heat from the driven LEDs and acquiring temperature corresponding to the heat; calculating the correct current, by referring to the acquired temperature and the wavelength of light emitted from the LED group; determining the correct drive current by adding the correct current to the drive current; and converting the correct drive current to the drive current for the selected LED group.

According to an aspect of the present invention, there is provided a method for controlling a light generating device with an LED module that includes a number of LED groups each of which has a number of LEDs, where the LED groups have different types of LEDs respectively, each group having the same type of LEDs. The method comprises: driving LEDs in a selected LED group using drive current, respectively; calculating wavelengths of the respective LEDs in the selected LED group; calculating a synthesized wavelength by interpolating the calculated wavelengths; calculating the correct current by comparing the synthesized wavelength with an optimal peak wavelength of light emitted from the LEDs in the selected LED group; calculating the correct drive current of the respective LEDs by adding the correct current to the drive current of the respective LEDs; and converting the correct drive current to the drive current of the respective LEDs.

The foregoing and other objects, features, aspects and advantages of the present invention will become more apparent from the following detailed description of the present invention when taken in conjunction with the accompanying drawings.

BRIEF DESCRIPTION OF THE DRAWING

The accompanying drawings, which are included to provide a further understanding of the invention and are incorporated in and constitute a part of this specification, illustrate embodiments of the invention and together with the description served to explain the principles of the invention.

In the drawings.

DETAILED DESCRIPTION OF THE PREFERRED EMBODIMENT

Hereinafter, exemplary embodiments of the invention are described in detail with reference to the accompanying drawings. The same reference numbers are used throughout the drawings to refer to the same or similar parts. Detailed descriptions of well-known functions and structures incorporated herein may be omitted to avoid obscuring the subject matter of the invention.

Figure 1:
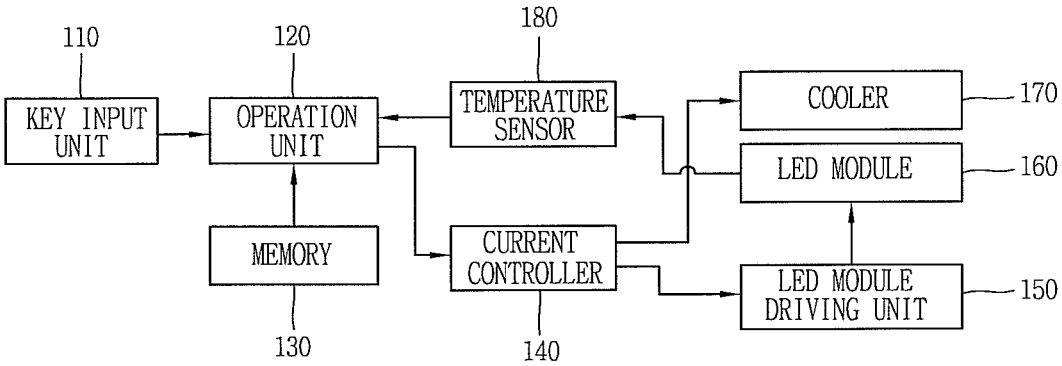
FIG. 1 is a schematic block diagram showing a light generating device according to an embodiment of the invention.
Figure 2:
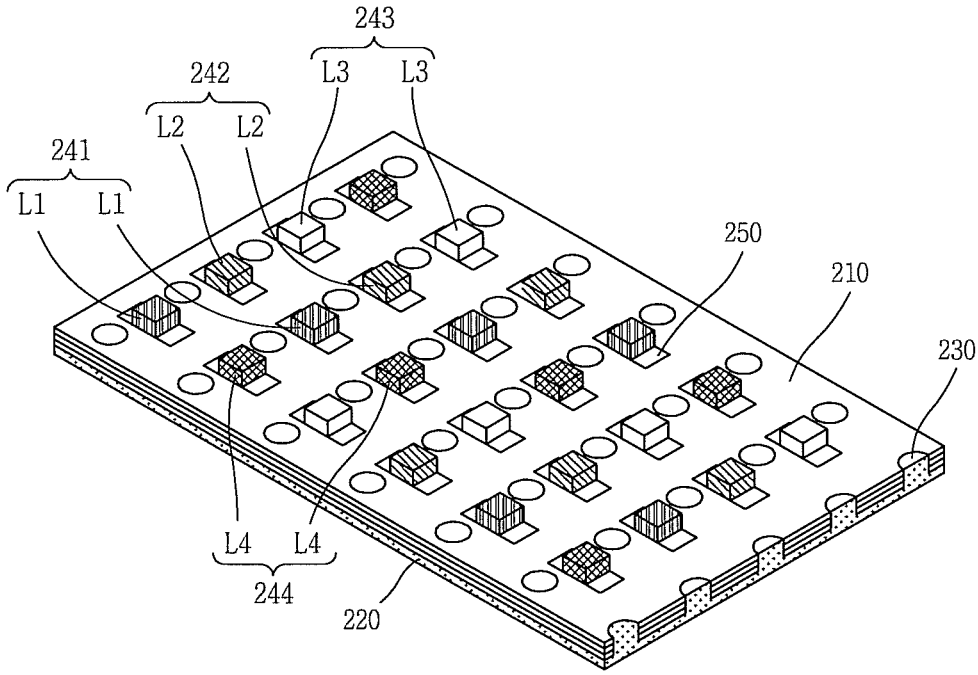
FIG. 2 is a perspective view showing the LED module of the light generating device shown in FIG. 1.

FIG. 1 is a schematic block diagram showing a light generating device according to an embodiment of the invention. FIG. 2 is a perspective view showing the LED module of the light generating device shown in FIG. 1.

Referring to FIG. 1, the light generating device includes a key input unit 110, an operation unit 120, a memory 130, a current controller 140, an LED module driving unit 150, an LED module 160, and a temperature sensor 180.

The LED module 160 includes a number of LED groups each of which has a number of LEDs. The LED groups have different types of LEDs respectively. The memory 130 stores drive current for a number of LED groups, respectively. The LED module driving unit 150 drives one of the LED groups that is selected, so that the selected LED group emits light. The current controller 140 controls the drive current flowing to the LED module driving unit 150 to drive the selected LED group. The temperature sensor 180 senses heat created from the selected LED group. The operation unit 120 calculates the correct drive current when LEDs in the selected LED group emit light, by referring to the drive current for driving the selected LED group and the temperature acquired by the temperature sensor 180, and transfers the correct drive current to the current controller 140. The key input unit 110 selects one of the LED groups or a number of LED groups.

In an embodiment of the invention, the operation unit 120 may be implemented with a Micro Controller unit (MCU) e.g., 8051 chip.

It is preferable that the memory 130 stores drive currents for respective LED groups when the light generating device is manufactured. However, the drive currents may be set by the user via the key input unit 110.

In an embodiment of the invention, the LED module driving unit 150 may be implemented with a DC-to-DC converter.

The LED module 160, as shown in FIG. 2, includes: a base plate 210 with LEDs L1 to L4 arrayed in a matrix form; a heat discharging layer 220 attached to the lower side of the base plate 210; and a number of heat transfer pins 230, passing through the base plate 210 to the heat discharging layer 220, for transferring heat from the LEDs to the heat discharging layer 220.

Referring to FIG. 2, the LED module is implemented in such a manner that a number of LEDs are arrayed on the base plate 210, classified with four types L1 to L4 for example, and respective types of LEDs form LED groups 241 to 244. That is, LED group 241 includes a type (L1) of LEDs, LED group 242 includes a type (L2) of LEDs, LED group 243 includes a type (L3) of LEDs, and LED group 244 includes a type (L4) of LEDs.

Each group includes the same type of LEDs to emit light with a corresponding peak wavelength. The peak wavelength of the light generated from LED module 160 may be appropriate to treat skin diseases, to grow plants, to protect against insects/to prevent diseases in plants, or to be applied to a source for precise optical systems.

LEDs are soldered to the base plate 210 via a printed pattern 250.

It is preferable that LEDs are implemented with a chip LED to increase the integrity per unit area and emit a large amount of light.

It is preferable that the heat discharging layer 220 is equipped with a cooler 170 to increase the heat discharge efficiency.

The base plate 210 is implemented with a printed circuit board (PCB), e.g., single-sided, double-sided, or multi layered.

The base plate 210 forms a number of via holes that do not affect a power supply wire and control signal lines printed thereon. The via-holes allow the heat transfer pins 230 to pass through respectively. It is preferable that the heat transfer pins 230 are spaced apart from each other at a certain distance over the base plate 210. It is preferable that the heat transfer pins 230 have the same cross-section as the via-holes. In an embodiment of the invention, although the cross-section of the heat transfer pins 230 is shaped as a circle, it should be understood that the invention is not limited to the embodiment. For example, the heat transfer pins 230 may be shaped, in the cross-section, as a rectangle, a triangle, etc.

The heat transfer pins 230 transfer heat generated from the LEDs of four types L1 to L4, installed to the base plate 210, to the heat discharging layer 220. The heat discharging layer 220 discharges the heat to the outside. As such, since the LED module can efficiently discharge heat generated from the LEDs via the heat transfer pins 230 and the heat discharging layer 220, it can prevent the LEDs from overheating and thus maintain the LEDs at a constant temperature.

In particular, the heat discharging layer 220 may be further equipped with a cooler 170 so that it can more efficiently discharge heat to the outside.

When the LED module 160 is operated in a light emitting mode, i.e., one of the LED groups 241 to 244 is set to be driven, the LED module 160 may serve as a display panel in order to display the mode.

On the other hand, the light generating device may further include an additional display panel for displaying a mode that is currently set or has been set.

Figure 3:
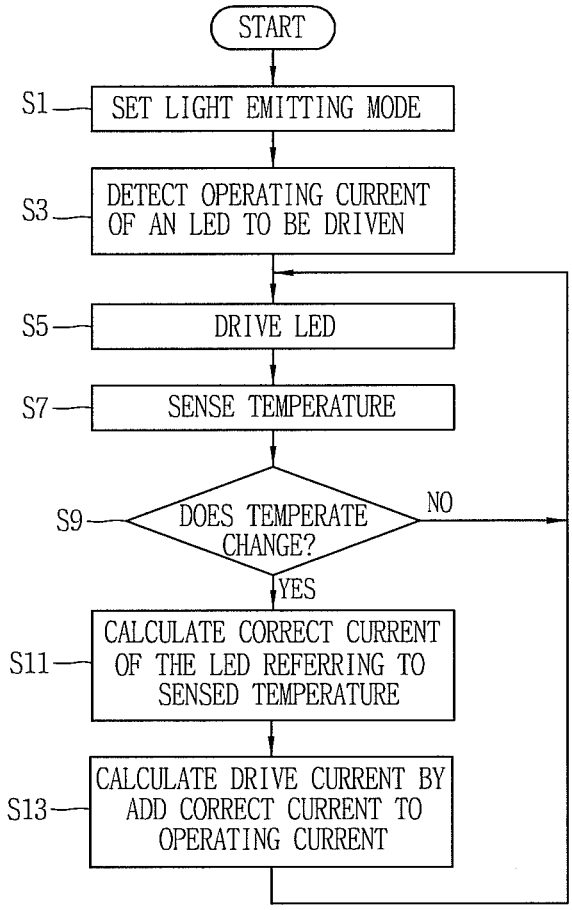
FIG. 3 is a flow chart that describes a method for controlling light wavelengths output from LEDs, according to an embodiment of the invention.

FIG. 3 is a flow chart that describes a method for controlling light wavelengths output from LEDs, according to an embodiment of the invention.

Referring to FIG. 3, when a light emitting mode is set, i.e., one of the LED groups 241 to 244 is selected to be driven, at step S1, the operation unit 120 reads the drive current of the LEDs in the selected LED group from the memory 130 at step S3, and then outputs them to the current controller 140. The current controller 140 outputs the current to the LEDs corresponding to the selected LED group so that they operate and emit at step S5.

The temperature sensor 180 senses heat generated from the LEDs at step S7 and S9. The operation unit 120 calculates the correct current of the LEDs outputting light with a preset optimal wavelength by using the temperature corresponding to the sensed heat and the wavelength of light generated from the LED module 160. The operation unit 120 calculates the correct drive current by adding the calculated correct current to the drive current read from the memory 130. The current controller 140 controls the LED module driving unit 150 to adjust the light wavelength of the LEDs in the selected LED group, based on the correct drive current.

The operation unit 120 calculates the correct current of the currently driven LEDs, referring to the temperature output from the temperature sensor 180 at step S11, and then adds the calculated correct current to the drive current of the LEDs, thereby acquiring the correct drive current for the LEDs at step S13. The correct current can be calculated via empirical values or a formula by using the temperature acquired by the temperature sensor 180 and the drive current of the LEDs stored in the memory 130.

The current controller 140 controls the LED module driving unit 150 to correct the light wavelength of the LEDs based on the correct drive current, thereby allowing the LEDs to generate light with a preset optimal light wavelength.

Since each of the LED groups emits a preset optimal light wavelength by using the method above, LED module 160 emits a preset optimal light wavelength.

Therefore, since the light generating device according to the invention can accurately control and maintain the light wavelength of the LEDs in the selected LED group, it can be applied to applications where the characteristic of light wavelength is used, for example, to treat skin diseases, to grow plants, to protect against insects, to prevent diseases in plants, and to require a accurate light source.

As described above, the first embodiment of the method generates an optimal light wavelength of the LEDs by controlling the current, which consumes a large amount of electric power.

Figure 4:
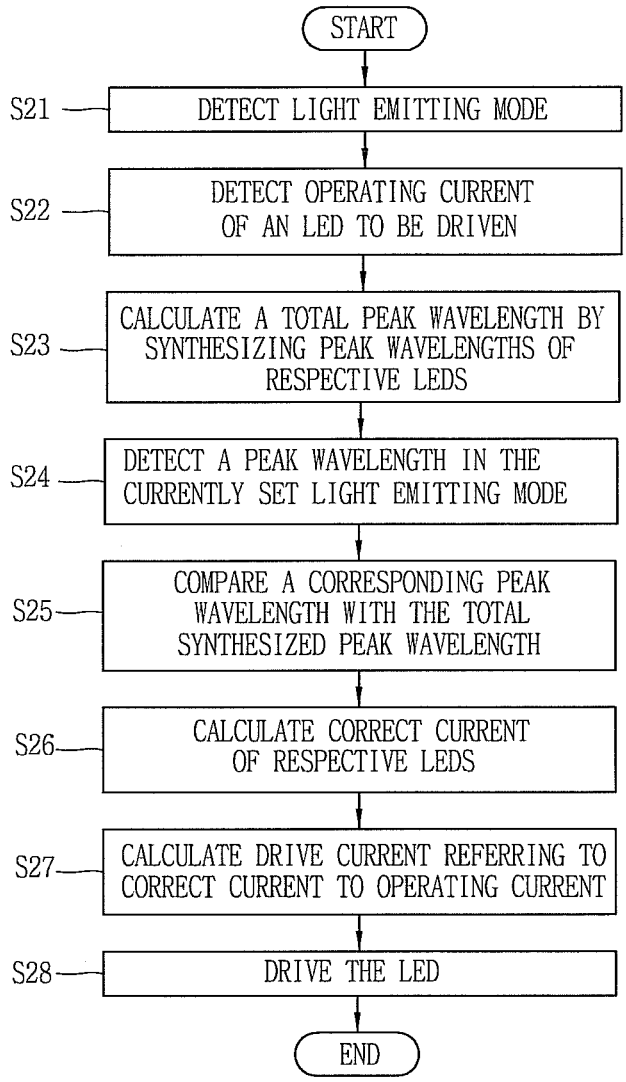
FIG. 4 is a flow chart that describes a method for controlling light wavelengths output from LEDs, according to another embodiment of the invention.

The following description is provided regarding a method for creating and adjusting a corresponding light wavelength from the LEDs by interpolating or synthesizing peak light wavelengths of the adjacent LEDs, referring to FIG. 4. FIG. 4 is a flow chart that describes a method for controlling a light wavelength output from LEDs, according to another embodiment of the invention.

The second embodiment of the method is performed to correct the deviation in the peak wavelengths of the LEDs that is caused due to the irregularity (±5 nm) of their manufacturing processes and aging in use.

A peak wavelength of the LEDs is required to be adjusted in an application where it is sensitive.

In the second embodiment of the method, the peak wavelength control algorithm is based on the principle where, when the interval between two peak wavelengths of two LEDs is less than approximately 1.698 times of half width half maximum (HWHM) of the LED, one peak can be created.

A function of light wavelength, f(λ), is expressed as the following equation (1).

$$f(\lambda) = A \cdot e^{-\left(\frac{\lambda-\lambda_p}{W}\right)^2} \quad \text{[Equation 1]}$$

Where A denotes amplitude, λ wavelength, $\lambda_p$ peak wavelength, and W width parameter of wavelength.

Figure 5A:
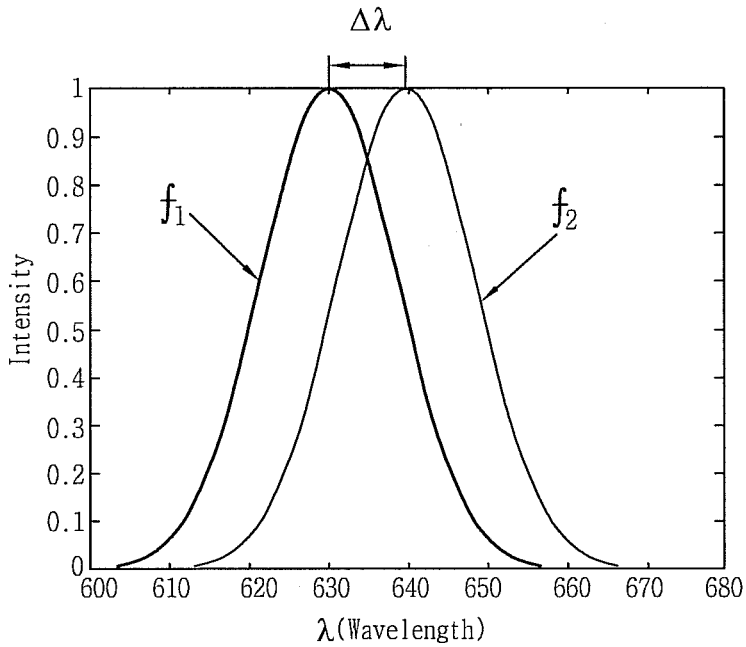
FIGS. 5A to 5C are wavelengths of the LED module, shown in FIG. 4, according to the wavelength interpolation.

When two LEDs are driven, the functions of light wavelengths, f1 and f2, as shown in FIG. 5A, can be expressed as the following equations (2) and (3).

$$f_1(\lambda) = A_1 \cdot e^{-\left(\frac{\lambda-\lambda_{p1}}{W_1}\right)^2} \quad \text{[Equation 2]}$$

-continued $$f_2(\lambda) = A_2 \cdot e^{-\left(\frac{\lambda-\lambda_{p2}}{W_2}\right)^2} \quad \text{[Equation 3]}$$

When the two light wavelengths are synthesized, a function of synthesized wavelength, f3, can be expressed as being composing functions f1 and f2, as the following equations (4).

$$f_3(\lambda) = A_1 \cdot e^{-\left(\frac{\lambda-\lambda_{p1}}{W_1}\right)^2} + A_2 \cdot e^{-\left(\frac{\lambda-\lambda_{p2}}{W_2}\right)^2} \quad \text{[Equation 4]}$$

When the function f3 is differentiated once, it can be expressed as the following equations (5).

$$\frac{d f_3(\lambda)}{d\lambda} = \frac{-2A_1}{W_1^2} \cdot (\lambda - \lambda_{p1}) \cdot e^{-\left(\frac{\lambda-\lambda_{p1}}{W_1}\right)^2} + \frac{-2A_2}{W_2^2} \cdot (\lambda - \lambda_{p2}) \cdot e^{-\left(\frac{\lambda-\lambda_{p2}}{W_2}\right)^2} \quad \text{[Equation 5]}$$

When the function f3 is differentiated twice, it can be expressed as the following equations (6).

$$\frac{d^2 f_3(\lambda)}{d\lambda^2} = \frac{-2A_1}{W_1^2} \cdot e^{-\left(\frac{\lambda-\lambda_{p1}}{W_1}\right)^2} - \frac{4A_1^2}{W_1^4} \cdot (\lambda - \lambda_{p1})^2 \cdot e^{-\left(\frac{\lambda-\lambda_{p1}}{W_1}\right)^2} + \frac{-2A_2}{W_2^2} \cdot e^{-\left(\frac{\lambda-\lambda_{p2}}{W_2}\right)^2} + \frac{4A_2^2}{W_2^4} \cdot (\lambda - \lambda_{p2}) \cdot e^{-\left(\frac{\lambda-\lambda_{p2}}{W_2}\right)^2} \quad \text{[Equation 6]}$$

When $A_1=A_2$ and $W_1=W_2$, Equation (6) can be expressed as unit function as the following equation (7).

$$\frac{d^2 f_{unit}(\lambda)}{d\lambda^2} = \frac{4A_1}{W^4} \cdot e^{-\frac{0.25\Delta\lambda^2}{W^2}} (0.5\Delta\lambda^2 - W^2) = 0 \quad \text{[Equation 7]}$$

Where Δλ denotes an interval between peak wavelengths of two LEDs.

When Equation (7) is arranged, Equation (8) can be acquired as follows.

$$\Delta\lambda > 1.698 W_H \quad \text{[Equation 8]}$$

Where $W_H$ denotes half width half maximum (HWHM).

When the interval Δλ between peak wavelengths of two LEDs is less than approximately 1.698 times of half width half maximum (HWHM) of the power of LED, one peak can be created.

Figure 5B:
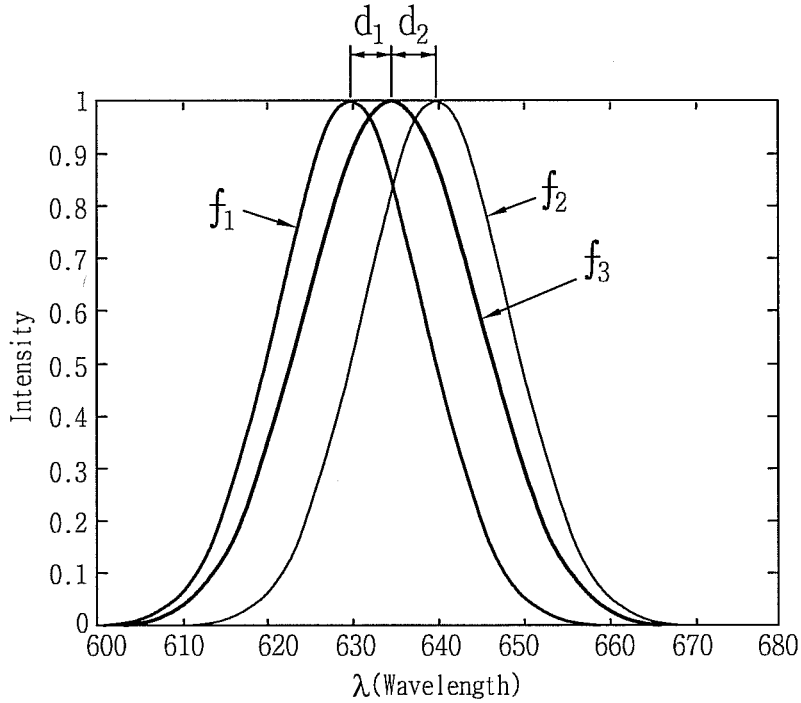
Figure 5C:
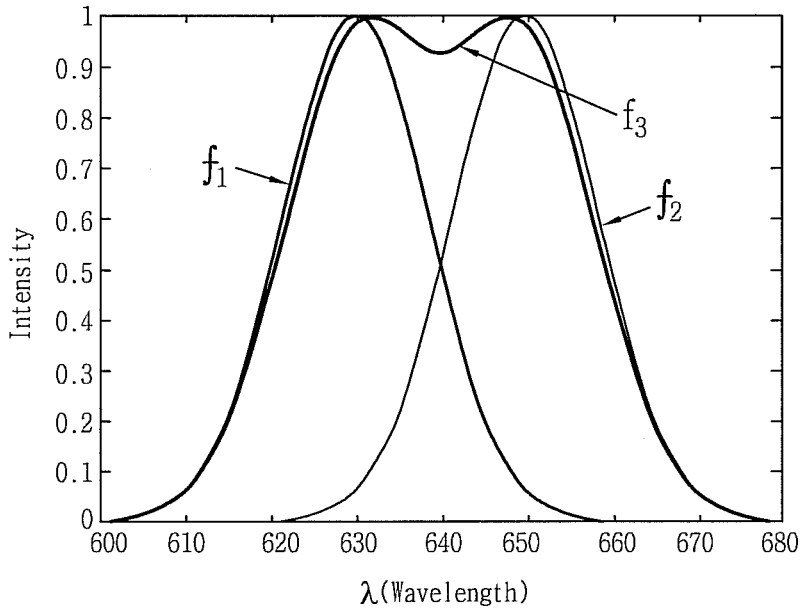

As shown in FIGS. 5B and 5C, since one or two peak wavelengths are created according to the interval Δλ between peak wavelengths of two LEDs, a mathematical analysis needs to create a function with one peak wavelength.

In order to create one peak wavelength, a condition can be acquired by differentiating the composition function f3 twice, which is described as follows.

When the composition function f3 has one peak wavelength, there are two inflection points (where a second-order differential coefficient is zero).

Therefore, Equation (5) can be expressed as the following equation (9).

$$\frac{df_3(\lambda)}{d\lambda} = \frac{-2A_1}{W_1^2}\cdot(\lambda-\lambda_{p1})\cdot e^{-\left(\frac{\lambda-\lambda_{p1}}{W_1}\right)^2} + \frac{-2A_2}{W_2^2}\cdot(\lambda-\lambda_{p2})\cdot e^{-\left(\frac{\lambda-\lambda_{p2}}{W_2}\right)^2} = 0 \quad \text{[Equation 9]}$$

When W1=W2, equation (9) can be arranged as the following equation (10).

$$A_1\cdot(\lambda-\lambda_{p1})\cdot e^{-\left(\frac{\lambda-\lambda_{p1}}{W_1}\right)^2} + A_2\cdot(\lambda-\lambda_{p2})\cdot e^{-\left(\frac{\lambda-\lambda_{p2}}{W_1}\right)^2} = 0 \quad \text{[Equation 10]}$$

When the ratio of light intensity between two LEDs is expressed by symbol 'C,' C is $A_1/A_2$. When Equation (10) is divided $A_2$, it can be expressed as the following equation (11).

$$C\cdot(\lambda-\lambda_{p1})\cdot e^{-\left(\frac{\lambda-\lambda_{p1}}{W_1}\right)^2} + (\lambda-\lambda_{p2})\cdot e^{-\left(\frac{\lambda-\lambda_{p2}}{W_1}\right)^2} = 0 \quad \text{[Equation 11]}$$

Therefore, when Equation (11) is expressed with respect to the ratio of light intensity C, it can be expressed as the following equation (12).

$$C = \frac{-(\lambda-\lambda_{p2})\cdot e^{-\left(\frac{\lambda-\lambda_{p2}}{W_1}\right)^2}}{(\lambda-\lambda_{p1})\cdot e^{-\left(\frac{\lambda-\lambda_{p1}}{W_1}\right)^2}} \quad \text{[Equation 12]}$$

Equation (12) can be re-arranged as the following equation (13).

$$C = \frac{-(\lambda-\lambda_{p2})}{(\lambda-\lambda_{p1})}\cdot e^{\left(\frac{\lambda-\lambda_{p1}}{W_1}\right)^2}\cdot e^{-\left(\frac{\lambda-\lambda_{p2}}{W_1}\right)^2} \quad \text{[Equation 13]}$$

When $$e^{-W_1^2} = N,$$

Equation (13) can be expressed as the following equation (14).

$$C = \frac{-(\lambda-\lambda_{p2})}{(\lambda-\lambda_{p1})}\cdot N^{(\lambda-\lambda_{p2})^2-(\lambda-\lambda_{p1})^2} \quad \text{[Equation 14]}$$

Since $d_1=\lambda-\lambda_{p1}$, $d_2=\lambda_{p2}-\lambda$, Equation (14) can be expressed as the following equation (15).

$$C = \frac{d_2}{d_1}\cdot N^{(d_2^2-d_1^2)} \quad \text{[Equation 15]}$$

Since $d_2=\Delta\lambda-d_1$, Equation (15) can be expressed as the following equation (16).

$$C = \left(\frac{\Delta\lambda}{d_1}-1\right)\cdot N^{\Delta\lambda(\Delta\lambda-2d_1)} \quad \text{[Equation 16]}$$

Referring to Equation (16), it will be noted that the ratio of light intensity

C means a ratio to create a corresponding peak wavelength.

When the ratio of light intensity C ($A_1/A_2$) between two LEDs is adjusted, the peak wavelength of the composition function f3 can also be adjusted.

Alternatively, one peak wavelength can be created from two peak wavelengths of the composition function f3. As shown in FIG. 5C, it will be noted that two peak wavelengths of the composition function f3 approximately meet the peak wavelengths of the LEDs.

Figure 6A:
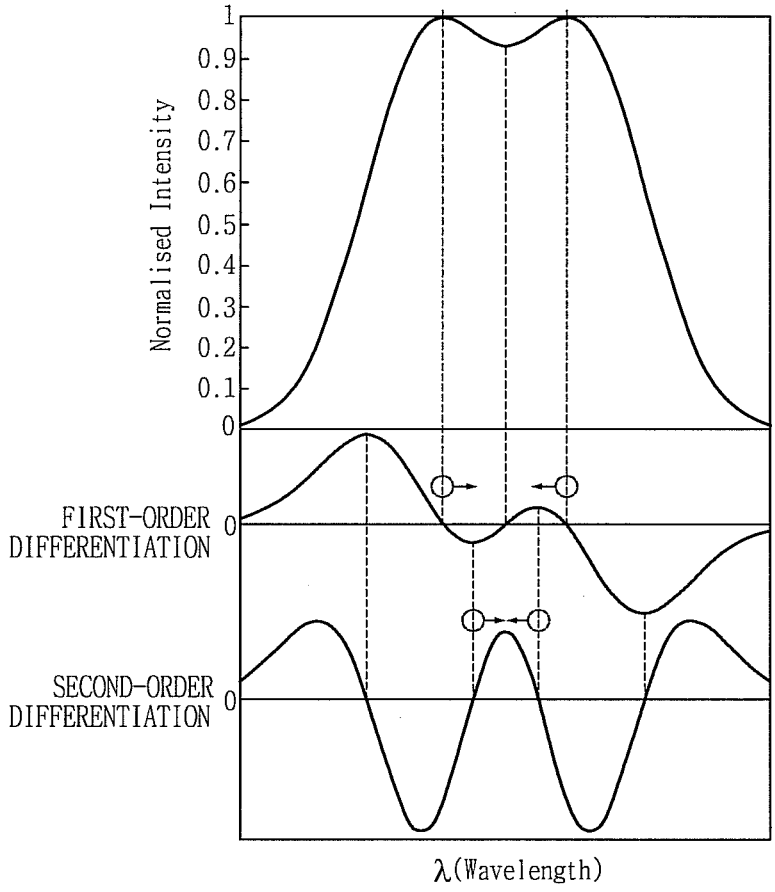
FIGS. 6A and 6B are wavelengths acquired by correcting the wave forms shown in FIG. 5C.

Therefore, when the peak wavelengths of the functions of light wavelengths f1 and f2 for the LEDs are adjusted, the composition function f3 with one peak wavelength can be created as shown in FIG. 6.

When the functions of wavelengths of two LEDs are composed as shown in FIG. 5A, a composition function with two peak wavelengths is created as shown in FIG. 5C. In that case, the composition function with two peak wavelengths needs to be corrected to have one peak wavelength.

Figure 6B:
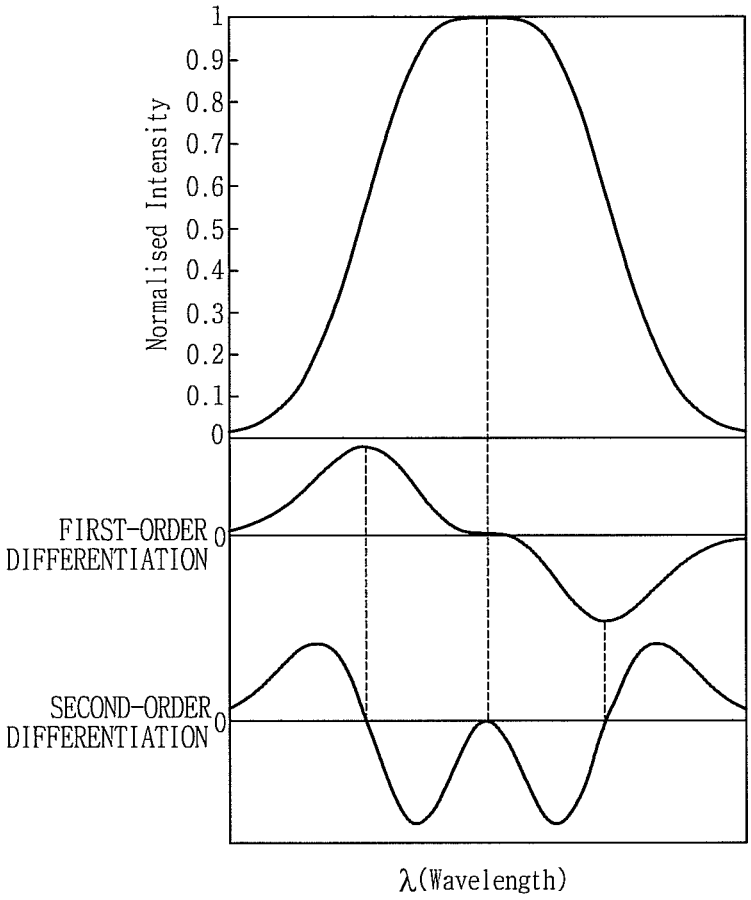

To do this, the position of the peak value of the first-order differential function is adjusted to create a function as shown in FIG. 6B.

Since the drive current of the LEDs is controlled by using a function with one peak value, the LEDs can create light with a constant wavelength.

Referring to FIG. 4, the second embodiment of the method is performed as follows. One of the LED groups 241 to 244 in the LED module 160 is selected. LEDs in the selected LED group are driven via their drive current in a light emitting mode at step S21. That is, the operation unit 120 detects one of the LED groups that is set in a light emitting mode via the key input unit 110.

The operation unit 120 reads the drive current of the LEDs from the memory 130 and controls the current controller 140 to drive them via the current at step S22.

The light wavelengths of the LEDs are calculated.

The operation unit 120 calculates a synthesized wavelength by interpolating the calculated light wavelengths at step S23 and S24. The operation unit 120 compares the synthesized wavelength with a preset optimal peak wavelength of the selected LED group at step S25, and calculates the correct current at step S26.

The operation unit 120 adds the correct current to the drive current of the LEDs in the selected LED group respectively, and then calculates the correct drive current of the LEDs respectively at step S27.

The operation unit 120 converts the correct drive current to drive current of the LEDs, and outputs it to the current controller 140. The current controller 140 controls the LED module 160 to adjust the wavelength of the LEDs based on the correct drive currents. Therefore, the LED module can output a corresponding light wavelength, i.e., a preset optimal light wavelength.

For example, when two of the LEDs in a selected LED group vary their operation characteristics due to the manufacturing tolerance or aging in use, they may output light with light wavelengths as shown in FIG. 5A. In that case, the operation unit 120 interpolates the two light wavelengths and creates a synthesized wavelength as shown in FIG. 5B. After that, the operation unit 120 calculates the correct current by comparing the synthesized wavelength with a preset optimal peak wavelength.

The operation unit calculates the final drive current (correct drive current), by referring to the drive current and the correct current. The current controller 140 controls the LED module driving unit 150 to operate the LED module 160, based on the final drive current. Therefore, the wavelength of the LEDs can be accurately controlled, considering the irregularity of the LED manufacturing process and the change in the peak wavelength according to current flow.

The light generating device is fed back with the drive current of the LED module 160, with the controlling of the wavelength of light output from the LED module 160, and adjusts the drive current, thereby guaranteeing the stable emission operation of the LED module 160.

The function of feeding back the drive current may be added to the current controller 140 or the operation unit 120.

In case peak wavelengths of light emitted from the respective the LED groups are different from each other, LED module 160 can emit the light of a preset optimal wavelength by using the principle of the second embodiment of the method.

As described above, since the light generating device can accurately control wavelength of light via temperature acquired by the LED module 160, it can prevent the variation of the peak wavelength due to the current variation and the irregularity of the LED manufacturing process.

Since the light generating device can constantly maintain the temperature of the LED module 160, it can prevent the malfunction of the LEDs due to heat and the change in the light wavelength. Therefore, the light generating device can increase the light emission efficiency.

In addition, since the light generating device can accurately generate light with a preset optimal wavelength from the LEDs, it can be applied to a variety of applications that require the characteristics of light wavelength, for example, skin disease treatment, growing plants, protecting against insects, preventing diseases in plants, and a source for precise optical systems.

As the invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A light generating device comprising:

an LED module that includes a number of LED groups each of which has a number of LEDs, where the LED groups have different types of LEDs respectively, each group having the same type of LEDs;

a memory for storing drive current for a number of LED groups, respectively;

an LED module driving unit for driving one of the LED groups that is selected, so that the selected LED group emits light;

a current controller for controlling the drive current flowing to the LED module driving unit to drive the selected LED group;

a temperature sensor for sensing heat created from the selected LED group;

an operation unit for calculating the correct drive current when LEDs in the selected LED group emit light, by referring to the drive current for driving the selected LED group and the temperature acquired by the temperature sensor, and transferring the correct drive current to the current controller; and a key input unit for selecting one of the LED groups or a number of LED groups.

2. The device according to claim 1, wherein the peak wavelength of the light generated from LED module may be is appropriate to treat skin diseases, to grow plants, to protect against insects/to prevent diseases in plants, or to be applied to a source for precise optical systems.

3. The device according to claim 1, wherein the LED module comprises:

a base plate with LEDs arrayed in the matrix form;

a heat discharging layer attached to the lower side of the base plate; and a number of heat transfer pins, passing through the base plate to the heat discharging layer, for transferring heat from the LEDs to the heat discharging layer.

4. The device according to claim 3, wherein the LED comprises:

a chip LED.

5. The device according to claim 3, wherein the heat discharging layer comprises:

a cooler.

6. The device according to claim 1, wherein the LED module driving unit comprises:

a DC-to-DC converter.

7. The device according to claim 1, wherein the operation unit calculates the correct drive current, by referring to the temperature acquired by the temperature sensor, and determines the correct drive current by adding the calculated correct current to the drive current.

8. The device according to claim 1, wherein the operation unit: calculates a synthesized wavelength by interpolating wavelengths of light emitted from the LEDs in the selected LED group; calculates the correct current by referring to a wavelength difference that is acquired by comparing the calculated synthesized wavelength with a preset optimal peak wavelength; and determines the correct drive current of the LEDs by adding the correct current to the drive current of the LEDs.

9. The device according to claim 8, wherein the correct current is calculated by the difference between the wavelength, synthesized by adjusting the amplitude of the wavelengths of light emitted from the LEDs, and the wavelengths of light emitted from the LEDs.

10. The device according to claim 1, further comprising:

a display panel for setting one of the LED groups in the LED module.

11. The device according to claim 1, wherein the LED module serves as a display for displaying a setting mode of an LED group.

12. The device according to claim 3, wherein the LED module serves as a display for displaying a setting mode of an LED group.

13. A method for controlling a light generating device with an LED module that includes a number of LED groups each of which has a number of LEDs, where the LED groups have different types of LEDs respectively, each group having the same type of LEDs, the method comprising:

driving the LEDs in a selected LED group using drive current;

sensing heat from the driven LEDs and acquiring temperature corresponding to the heat;

calculating the correct current, by referring to the acquired temperature and the wavelength of light emitted from the LED group;

determining the correct drive current by adding the correct current to the drive current; and converting the correct drive current to the drive current for the selected LED group.

14. The method according to claim 13, wherein the correct current is calculated by the difference between a wavelength synthesized by adjusting an amplitude of a wavelength of light emitted from the LEDs and a wavelength of light emitted from the LEDs.

15. The method according to claim 14, wherein:

the amplitude is adjusted via the ratio of light intensity (C) respective LEDs; and the ratio of light intensity (C) meets the following condition $$C = \left(\frac{\Delta\lambda}{d_1} - 1\right) \cdot N^{\Delta\lambda(\Delta\lambda - 2d_1)}$$

where: $C=A_1/A_2$; $A_1$ and $A_2$ denote the amplitudes of functions of wavelengths; $d_1=\lambda_1-\lambda_{p1}$; $d_2=\lambda_{p2}-\lambda=\Delta\lambda-d_1$;

$$e^{-w_1^2} = N;$$

$d_1$ and $d_2$ denote distances between the peak wavelength of the composition function and the peak wavelengths of the functions of light wavelength; and $\Delta\lambda$ is an interval between peak wavelengths of two LEDs.

16. A method for controlling a light generating device with an LED module that includes a number of LED groups each of which has a number of LEDs, where the LED groups have different types of LEDs respectively, each group having the same type of LEDs, the method comprising:

driving LEDs in a selected LED group using drive current, respectively;

calculating wavelengths of the respective LEDs in the selected LED group;

calculating a synthesized wavelength by interpolating the calculated wavelengths;

calculating the correct current by comparing the synthesized wavelength with an optimal peak wavelength of light emitted from the LEDs in the selected LED group;

calculating the correct drive current of the respective LEDs by adding the correct current to the drive current of the respective LEDs; and converting the correct drive current to the drive current of the respective LEDs.

17. The method according to claim 16, wherein the correct current is calculated by the difference between a wavelength synthesized by adjusting an amplitude of a wavelength of light emitted from the LEDs and a wavelength of light emitted from the LEDs.

18. The method according to claim 17, wherein:

the amplitude is adjusted via the ratio of light intensity (C) respective LEDs; and the ratio of light intensity (C) meets the following condition $$C = \left(\frac{\Delta\lambda}{d_1} - 1\right) \cdot N^{\Delta\lambda(\Delta\lambda - 2d_1)}$$

where: $C=A_1/A_2$; $A_1$ and $A_2$ denote the amplitudes of functions of wavelengths; $d_1=\lambda_1-\lambda_{p1}$; $d_2=\lambda_{p2}-\lambda=\Delta\lambda-d_1$;

$$e^{-w_1^2} = N;$$

$d_1$ and $d_2$ denote distances between the peak wavelength of the composition function and the peak wavelengths of the functions of light wavelength; and $\Delta\lambda$ is an interval between peak wavelengths of two LEDs.

* * * * *